US008905582B2

(12) United States Patent
Chan et al.

(10) Patent No.: US 8,905,582 B2
(45) Date of Patent: Dec. 9, 2014

(54) COLLAPSIBLE DECORATIVE SYSTEM

(75) Inventors: Yuk Lung Chan, Hong Kong (CN); Po Wai Andy Wong, Hong Kong (CN)

(73) Assignee: Polygroup Macau Limited (BVI), Tortola (VG)

( * ) Notice: Subject to any disclaimer, the term of this patent is extended or adjusted under 35 U.S.C. 154(b) by 167 days.

(21) Appl. No.: 12/755,754

(22) Filed: Apr. 7, 2010

(65) Prior Publication Data

US 2010/0254160 A1 Oct. 7, 2010

Related U.S. Application Data

(60) Provisional application No. 61/167,244, filed on Apr. 7, 2009.

(51) Int. Cl.

| | |
|---|---|
| ***F21S 4/00*** | (2006.01) |
| ***F21V 21/00*** | (2006.01) |
| ***A47G 33/06*** | (2006.01) |
| ***F21V 1/06*** | (2006.01) |

(52) U.S. Cl.

CPC . *A47G 33/06* (2013.01); *F21V 1/06* (2013.01); *Y10S 362/806* (2013.01)

USPC .. 362/249.16; 362/653; 362/806; 362/249.14

(58) Field of Classification Search

USPC ..... 362/249.16, 806, 653, 249.01, 808, 362/249.09, 249.11, 249.15, 249.18, 362/249.19; 428/12

See application file for complete search history.

(56) References Cited

U.S. PATENT DOCUMENTS

| | | | | |
|---|---|---|---|---|
| 4,167,034 | A * | 9/1979 | Noguchi | 362/414 |
| 6,419,373 | B1 * | 7/2002 | Shieh | 362/249.01 |
| 6,579,578 | B1 * | 6/2003 | Lai | 428/12 |
| 7,682,060 | B2 * | 3/2010 | Wang | 362/565 |
| 8,721,122 | B2 * | 5/2014 | Tong | 362/249.14 |
| 2005/0185410 | A1 * | 8/2005 | Liao et al. | 362/352 |
| 2008/0310165 | A1 * | 12/2008 | Li | 362/252 |
| 2009/0296397 | A1 * | 12/2009 | Gibboney, Jr. | 362/249.16 |
| 2011/0076425 | A1 * | 3/2011 | Cheng et al. | 428/8 |

* cited by examiner

*Primary Examiner* — Anh Mai
*Assistant Examiner* — Jessica M Apenteng
(74) *Attorney, Agent, or Firm* — Troutman Sanders LLP; Ryan A. Schneider; Benjamin C. Wiles

(57) ABSTRACT

A decorative system includes a base, a first frame assembly, a second frame assembly, a decorative covering, and a mount assembly, wherein the decorative system can be placed in a use state and a collapsed state. The base provides the foundation of the decorative system. The first frame assembly comprises a first frame, which generally is a skeleton or support framework. The second frame assembly comprises a second frame, which also is generally a skeleton or support framework. The decorative covering includes a covering having a decorative feature, for example, transparent, translucent, and opaque portions. The mount assembly provides support, and can be in communication with the first and second frame assemblies for assembly of the decorative system. The decorative system can further comprise a light string system that can be carried by at least one of the first frame assembly, the second frame assembly and/or the decorative covering.

17 Claims, 11 Drawing Sheets

COLLAPSIBLE DECORATIVE SYSTEM

CROSS-REFERENCE TO RELATED APPLICATIONS

This application claims the benefit, under 35 U.S.C. §119 (e), of U.S. Provisional Application Ser. No. 61/167,244, filed 7 Apr. 2009, the entire contents and substance of which are hereby incorporated by reference.

BACKGROUND

Various aspects of the present invention relate to decorative systems and, more particularly, to collapsible decorative systems.

Decorative systems are widely used during holidays, festivals, and in celebrations. Oftentimes decorative systems are fixed objects, such that they cannot be broken down or collapsed. Over time, manufacturers and suppliers have realized the need to fold or collapse decorative systems for storage and/or shipping reasons.

In particular, one problem with decorative systems is that their shipping costs are often higher because they tend to be bulky, as shipping costs are now commonly associated both with weight and size of the container housing the decorative system.

SUMMARY

Briefly described, aspects of the present invention comprise a decorative system comprising a base, a first frame assembly, a second frame assembly, a decorative covering, and a mount assembly. Optionally, the decorative system can further comprise a light string system.

The base provides the foundation of the decorative system. The base can be the lowest support of the decorative system, and often is in contact with the surface upon which the decorative system rests.

The first frame assembly comprises a first frame, which generally is a skeleton or support framework. Likewise, the second frame assembly comprises a second frame, which also is generally a skeleton or support framework.

The decorative covering can be in communication with the first and second frame assemblies. The decorative covering can provide a covering for decoration purposes. Exemplarily, the decorative covering can include a decorative feature, for example, transparent, translucent, and opaque portions.

The mount assembly provides support for the decorative system, and can be in communication with the first and second frame assemblies for assembling of the decorative system.

The first frame assembly and the second frame assembly can be in communication with one another via the mount assembly. The mount assembly is adapted to collapse or fold enabling the first and second frame assemblies to create a thin profile. The first frame assembly and the second frame assembly can be in communication via the decorative covering, and may be coupled to the same decorative covering. Removal and/or disassembly of the mount assembly from its communication with the first frame assembly and the second frame assembly enables the decorative light system to collapse creating a thin profile.

If desired, a light string system can be included in the decorative system. The light string system can be carried by the first frame assembly, the second frame assembly, and/or the decorative covering. The light string system comprises wiring, a plurality of bulb assemblies, each bulb assembly comprising a light source to illuminate the light string system, and a socket assembly.

These and other objects, features, and advantages of the present invention will become more apparent upon reading the following specification in conjunction with the accompanying drawings.

DETAILED DESCRIPTION

Figure 1:
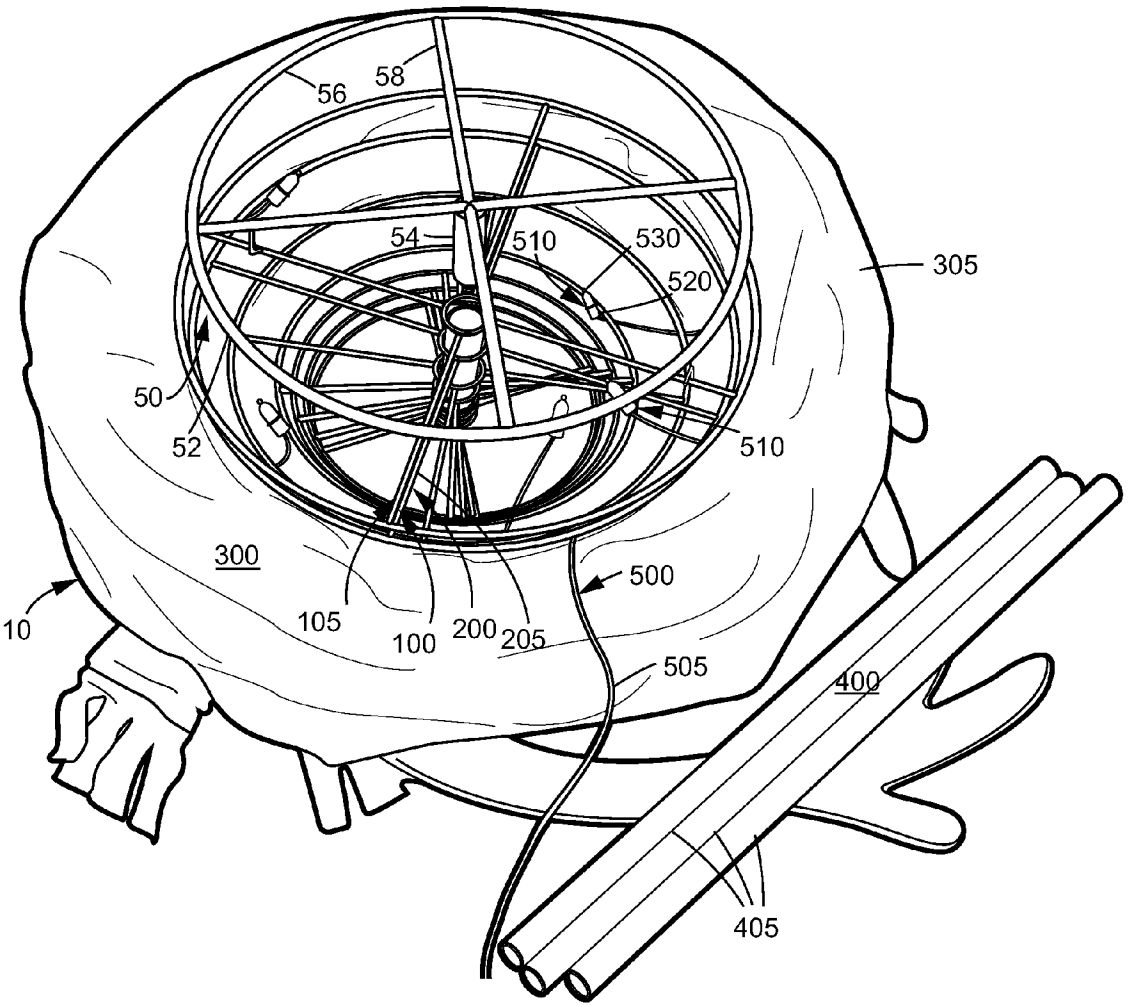
FIG. 1 illustrates a perspective view of elements of a decorative system in a collapsed state, in accordance with an exemplary embodiment of the present invention.

To facilitate an understanding of embodiments, principles, and features of the present invention, they are explained hereinafter with reference to implementation in an illustrative embodiment. In particular, they are described in the context of being a collapsible system. Embodiments of the present invention are also described in the context of a collapsible decorative system for the collapsing or folding of a decorative system. Further, embodiments of the present invention are described in the context of a collapsible decorative light system for the collapsing or folding of a decorative light system.

Embodiments of the present invention, however, are not limited to use in the described systems. Rather, embodiments of the present invention can be used when a collapsible system is desired or necessary. Thus, the system described hereinafter as a collapsible system can also find utility as a system for other applications, beyond that of a decorative system or decorative light system.

The components described hereinafter as making up the various embodiments are intended to be illustrative and not restrictive. Many suitable components that would perform the same or a similar function as the materials described herein are intended to be embraced within the scope of embodiments of the present invention.

Referring now to the figures, wherein like reference numerals represent like parts throughout the views, embodiments of the present invention will be described in detail. A collapsible decorative system is collapsible for, among other things, storage and/or shipping savings.

Figure 7:
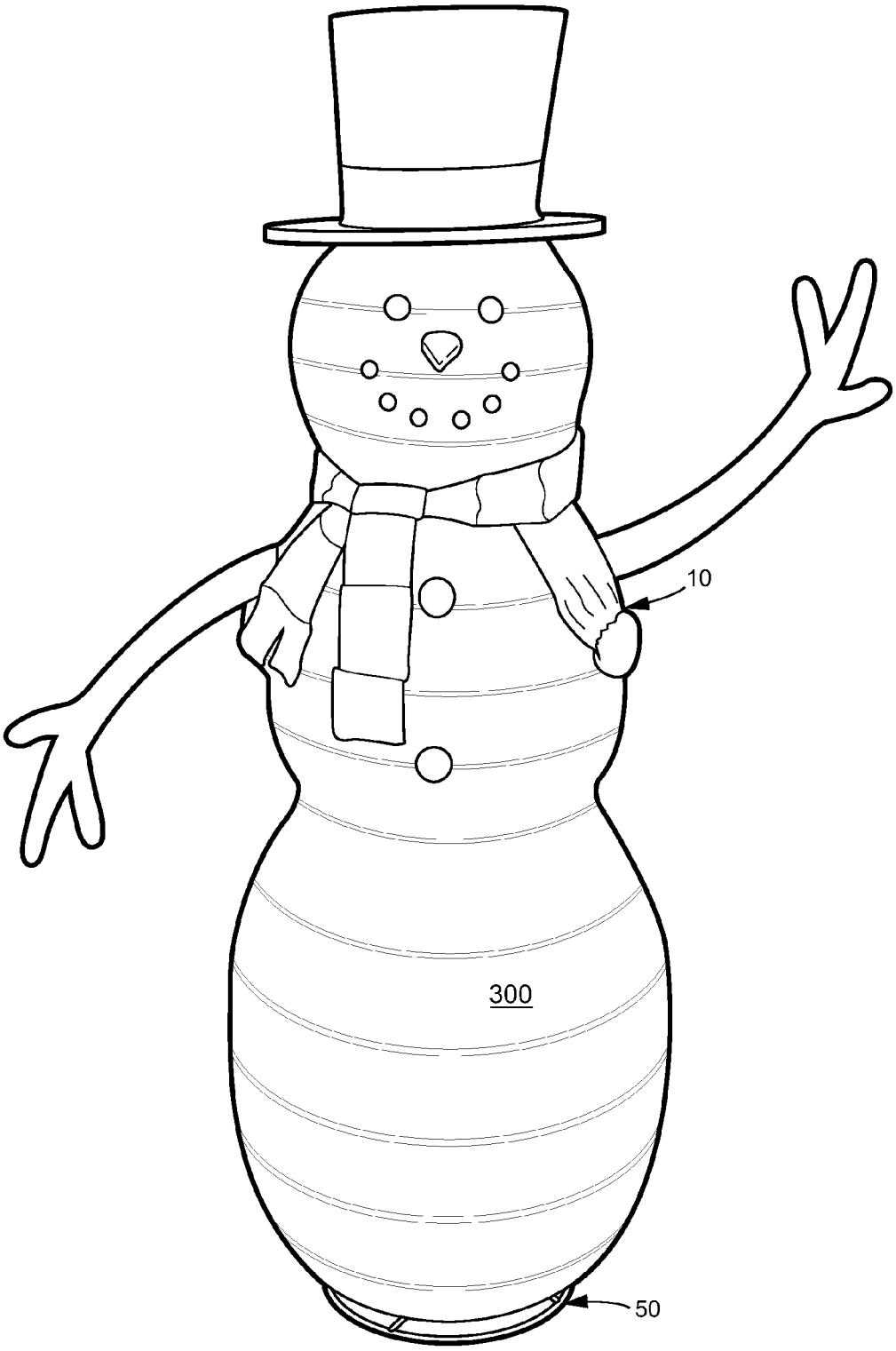
FIG. 7 illustrates a side view the decorative system in an assembled state, in accordance with an exemplary embodiment of the present invention.
Figure 8:
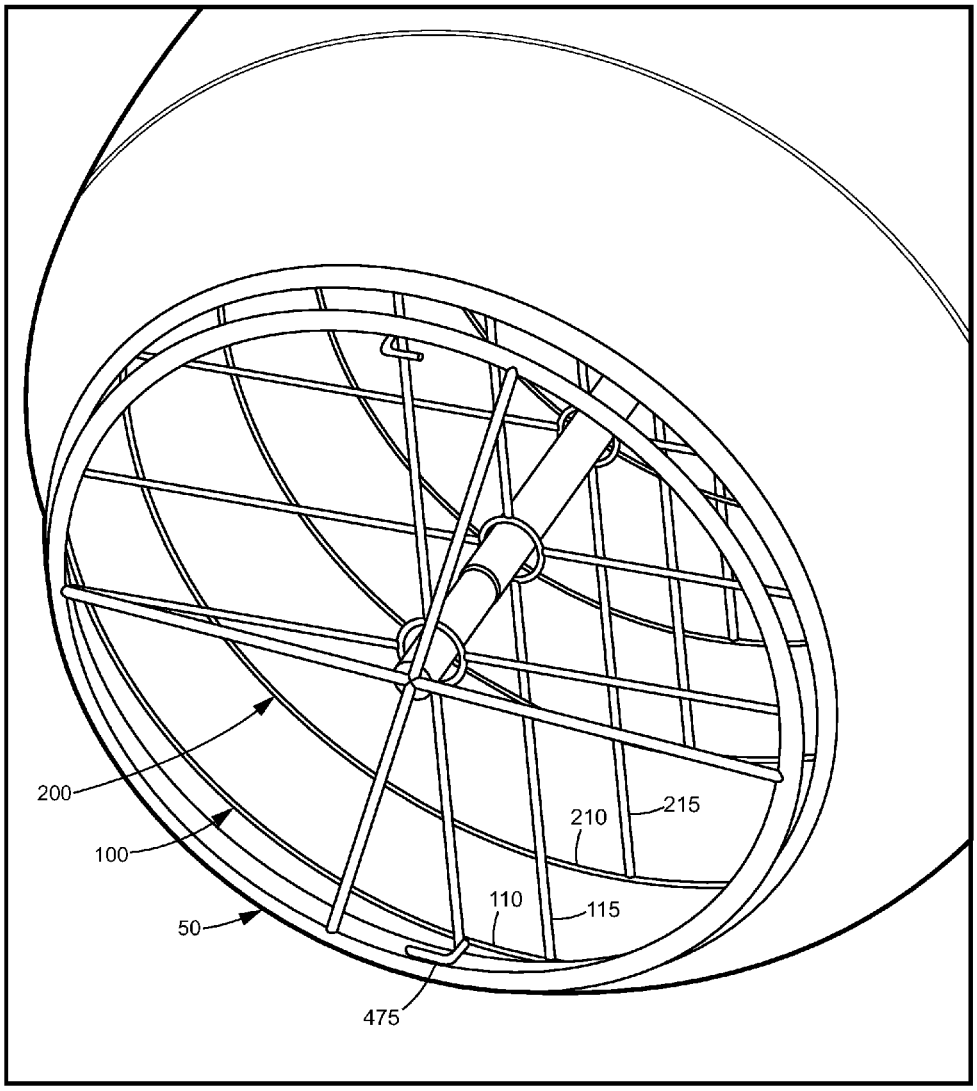
FIG. 8 illustrates a bottom view of the base connected to the mount assembly, in accordance with an exemplary embodiment of the present invention.
Figure 9:
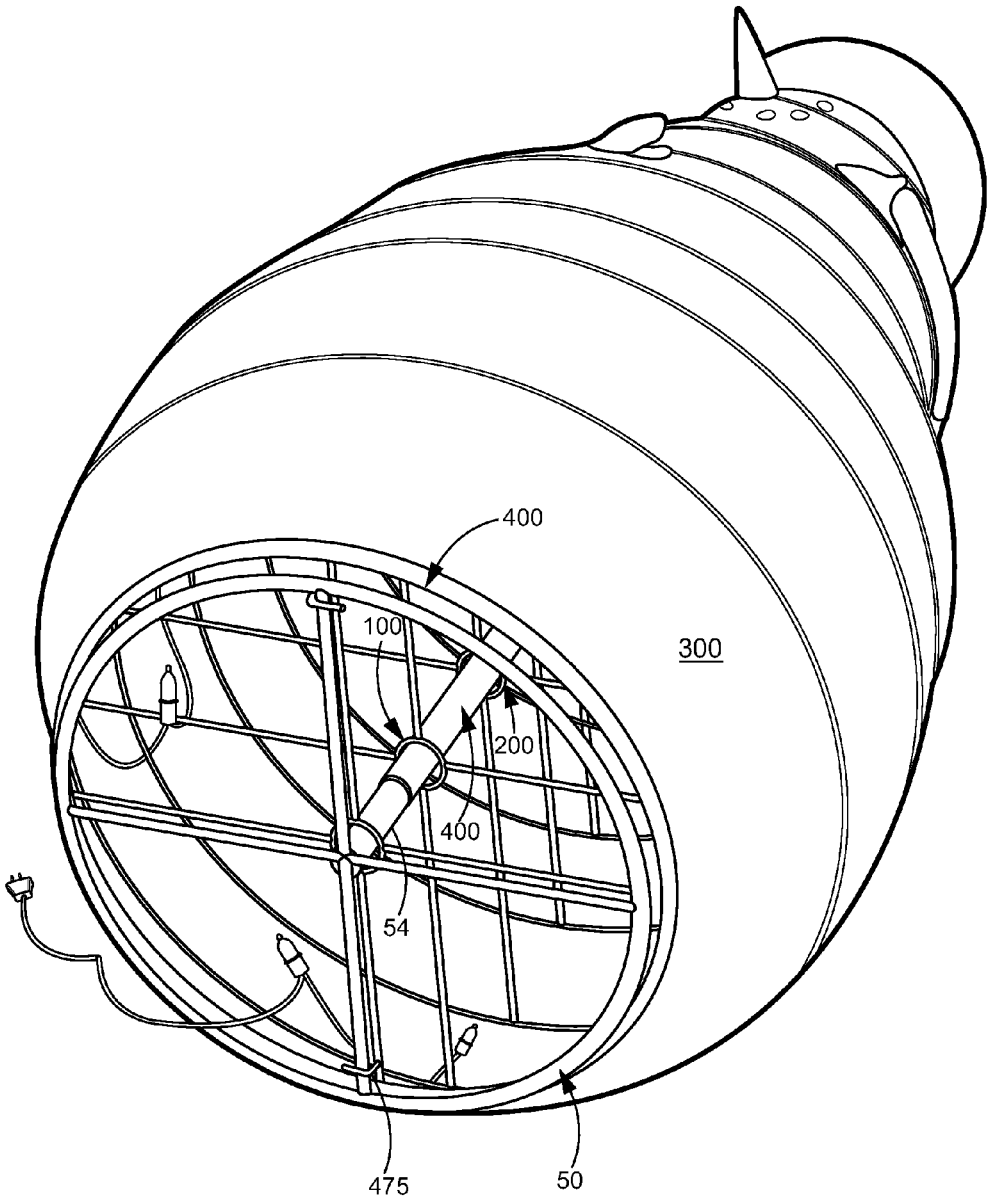
FIG. 9 illustrates a bottom view of the base locked to the mount assembly, in accordance with an exemplary embodiment of the present invention.

As shown in FIGS. 1 and 7, a decorative system can have at least a first state and a second state. The first state, as illustrated in FIG. 1, is a collapsed state, preferable when shipping and/or storing the decorative system. Oppositely, the second state, as illustrated in FIG. 7, is an assembled state, preferable when using and displaying the decorative system.

As shown in FIG. 1, aspects of the decorative system 10 comprise a base 50, a first frame assembly 100, a second frame assembly 200, a decorative covering 300, and a mount assembly 400. The decorative system can further comprise a light string system 500.

The base 50 provides the foundation of the decorative system 10, and can be the lowest support of the decorative system 10. The base 50 is often in contact with the surface upon which the decorative system 10 rests.

The first frame assembly 100 comprises a first frame 105, which generally is a skeleton or support framework. The second frame assembly 200 comprises a second frame 205, which also is generally a skeleton or support framework. The first and second assemblies 100 and 200 can be placed atop/beneath one another.

The decorative covering 300 can be in communication with the first frame assembly 100 and second frame assembly 200, which can provide the structure and/or shape of the decorative system 10. Exemplarily, the decorative covering 300 can include a decorative feature, for example, transparent, translucent, and opaque portions.

The mount assembly 400 provides support, and can be in communication with the first frame assembly 100 and the second frame assembly 200 for assembly of the decorative system 10.

The first frame assembly 100 and the second frame assembly 200 can be in communication with one another via the mount assembly 400. The mount assembly 400 is adapted to collapse or fold causing the first and second frame assemblies 100 and 200 to have a thin profile. The first frame assembly 100 and the second frame assembly 200 can be in communication via the decorative covering 300, and may be coupled to the same decorative covering 300. Removal of the mount assembly 400 from its communication with the first frame assembly 100 and the second frame assembly 200 enables the decorative system 10 to collapse creating a thin profile.

Further, a light string system 500 can be included in the decorative system 10. The light string system 500 can be carried by the first frame assembly 100, the second frame assembly 200, and/or the decorative covering 300. The light string system 500 comprises wiring 505, a plurality of bulb assemblies 510, each bulb assembly 510 comprising a light source 530 to illuminate the light string system, and a socket assembly 520.

FIGS. 1 and 4-9 illustrate various views of the base 50 of the decorative system 10. The base 50 is the bottom and support for the decorative system 10. In an exemplary embodiment, the base 50 includes a bottom 52, which can be rather flat, and an outwardly extending member 54, which exemplarily extends in an upwardly direction. The base 50, as shown in the figures, can include a rigid perimeter 56 and an interior member 58. In an exemplary embodiment, the extending member 54 is coupled to a portion of the interior member 58. For example, the perimeter member 56 can have a circular shape, which is held together by the interior member 58, having at least two intersecting elongated members, which, for example, can form an X-shape, wherein the approximate center of the X-shape is in communication with the extending member 54. The interior member(s) 58 of the base 50 can include other shapes to support the extending member 54. The bottom 52 of the base 50 can be positioned on a surface upon which the decorative system 10 shall rest.

As illustrated in FIGS. 1-3 and 7-9, the decorative system 10 includes at least two frame assemblies, e.g., the first frame assembly 100 and the second frame assembly 200. In an exemplary embodiment, there can be a plurality of frame assemblies used to help support a sized decorative covering 300. Depending on the shape and size of the decorative system 10, a plurality of frame assemblies can be included and may or may not be connected or in communication with one another. The first frame assembly 100 comprises a first frame 105, which generally is a skeleton or support framework. The second frame assembly 200 comprises a second frame 205, which also is generally a skeleton or support framework. The frame assemblies 100 and 200 collectively can form the general shape of the decorative system 10.

The frames 105 and 205 can be made of a metal, plastic, and the like to provide the stability needed for the decorative system 10 to maintain its decorative shape. The frames 105 and 205 are generally white, but can be many alternative colors. The frames 105 and 205 need not be limited only to the border/perimeter of the design, but used internally not only to provide further rigidity. Portions of the frames 105 and 205 can provide transition, displaying a three-dimensional depth of the decorative light system, and also provide borders of the design.

Each frame 105/205 of each frame assembly 100/200 includes a perimeter member 110 and 210, respectively, and an interior member 115 and 215, respectively. As illustrated, each interior member 115 and 215 is in communication with a defined opening 120 for receiving a portion of the mount assembly 400, as described in more detail below. In an exemplary embodiment, each perimeter 110/210 has a particular shape that can help form the overall shape of the decorative system 10.

In the illustrated embodiment, the decorative system 10 is a snowman, and as a result, the perimeter of each frame can be an approximate circle, which can have different diameters. In an exemplary embodiment, for supporting the perimeter member 110/210, the interior member 115/215 includes an X-shape with the defined opening or a ring 120 at the approximate center of the perimeter 110. Other shapes for the interior member and perimeter member can be provided, and hence the shape of the decorative system 10 can change accordingly.

The decorative covering 300 can be weaved about and/or carried by the perimeter member 110 and/or 210 of the frame assemblies 100 and 200. In other words, the decorative covering 300 can be in communication with the first frame assembly 100 as well as second frame assembly 200. As a result, the first and second frame assemblies 100 and 200 can provide the structure and/or shape of the decorative system 10. The decorative covering 300 can include a decorative feature, for example, transparent, translucent, and opaque portions.

The decorative system 10 provides decoration, because people enjoy decorating in the spirit of the holidays. For example, the decorative covering 300, as shown in the figures, can be a snowman in an exemplary design.

Further, the following is a list, for example and not limitation, of potential decorative systems: gifts, candy cane(s), Santa Claus, reindeer, Christmas tree(s), North Pole, elf, manger, cross, ornament, sled, holly, bells, stockings, star, candles, sack of gifts, wreath, mistletoe, and the like.

Christmas, however, is not the only holiday for which the decorative system 10 can be designed. The holiday of Halloween can include a decorative system 10 too, for example, illustrating black cat(s), ghost(s), witch(es), bat(s), pumpkin(s), and jack-o-lantern(s). In addition, the holiday of Thanksgiving can include a decorative system 10, for instance, turkey, cornucopia, pilgrims, Indians, ships, and the like. Still other events, such as Independence Day, birthdays, and Easter can provide decorative light systems. Other examples can include flags (e.g., countries, sports teams, states, and the like) and spelled-out words (e.g., "Happy Birthday," and "Congratulations"). The decorative system 10 is capable of both indoor and outdoor use.

The decorative covering 300, along with the frame assemblies 100 and 200, can provide the shape of the decorative system 10, which is ultimately supported by the mount assembly 400.

The decorative covering 300 is a covering for creating a desired shape and comprises a cover layer 305. The cover layer 305 may be many materials having a desired durableness, rigidity, and flexibility to form a cover, for example and not limitation, textile fabrics, non-woven substances, cloth, plastic, polystyrene, paper, glass, leather, vinyl, rubber, flexible or rigid foam, PVC, acrylic, polyester, nylon, silk, Mylar, metal, and/or cellophane. The cover layer 305 can be a single piece of material, or it may comprise individual sections that can be sewn, melted, taped, or glued together.

In some embodiments, the material of the cover 305 can be a transparent or translucent fabric or a material that refracts light, such as a transparent vitreous material, or a plastic material such as PVC or acrylic. In some embodiments, the material can be opaque with a plurality of holes punched therein. In some embodiments, the cover layer 305 can be a screen or mesh of material. The cover layer 305 can also be a combination of materials.

The cover layer 305 can be coupled to the frame assemblies 100 and 200. For example and not limitation, the cover layer 305 can be coupled to the perimeter member 110/210 of the respective frame assembly 100/200. In some embodiments, the cover layer 305 can be made of flexible material that can be stretched between two or more rods or ribs of the frame assemblies 100 and 200, and can be securely adhered to the frame assemblies 100 and 200 in various locations. For example and not limitation, edge portions of the cover layer 305 can be glued or otherwise attached to the frame assemblies 100 and 200, and areas of the cover layer 305 between the edge portions may also be attached to the frame assemblies 100 and 200.

In some embodiments, the cover layer 305 is configured to provide decorative and functional aspects to the light string system 500 (described more fully below) for a more colorful or attractive scene. For example and not limitation, the cover layer 305 can be a refractive material creating a dazzling phenomenon when light emitted from the light source 530 penetrates into and refracted through the cover layer 305. In some embodiments, the cover layer 305 can be a reflective material creating a dazzling reflection of light from the light source to exude a brilliant and more illuminated decoration.

In some embodiments, the cover layer 305 can be tinted, colored, or patterned. For example and not limitation, if the decorative system 10 is substantially formed into the shape of a snowman, a section of the cover layer 305 at the hands of the snowman may be tinted or patterned to appear glove-like, such as with black tint or coloring, or a section of the cover layer 305 at a nose of the snowman may be tinted or pattered to appear carrot-like, such as with orange tint or coloring. Furthermore, a specific pattern of colors, for example an ornament on a Christmas tree, a Santa Claus costume, or the stripe or bell of a deer, could be added to the cover layer to enrich the variations of the formed decorative system. Also, the shape of the perimeter member of the frame assembly(ies) can aid in the shape of the overall decoration.

In some embodiments, the decorative covering 300 can comprise a fibrous material comprising a plurality of outwardly extending fibers coupled to at least a portion of the decorative covering 300. For example and not limitation, this fibrous material can be tinsel.

The mount assembly 400 can enable the decorative system 10 to change from the assembled state to the collapsed state, and vice versa. The mount assembly 400 can be a vertical support element for supporting the decorative system 10 in its assembled state. The mount assembly 400 can be a center mount, as illustrated in the figures, for supporting the decorative system 10 in its assembled state. In an exemplary embodiment, the mount assembly 400 can be an elongate rod 405, or a plurality of elongate rods coupled to ends of one or more other elongate rods. In another embodiment, the mount assembly 400 can include a telescoping rod and can adjust to different lengths, as desired or needed.

The mount assembly 400 can be attached to a top end assembly 450, which is positioned at the top of the decorative system 10. The top end assembly 450 can receive a portion or be inserted into a portion of the mount assembly 400, e.g., one of the ends of the elongate rods.

Figure 2:
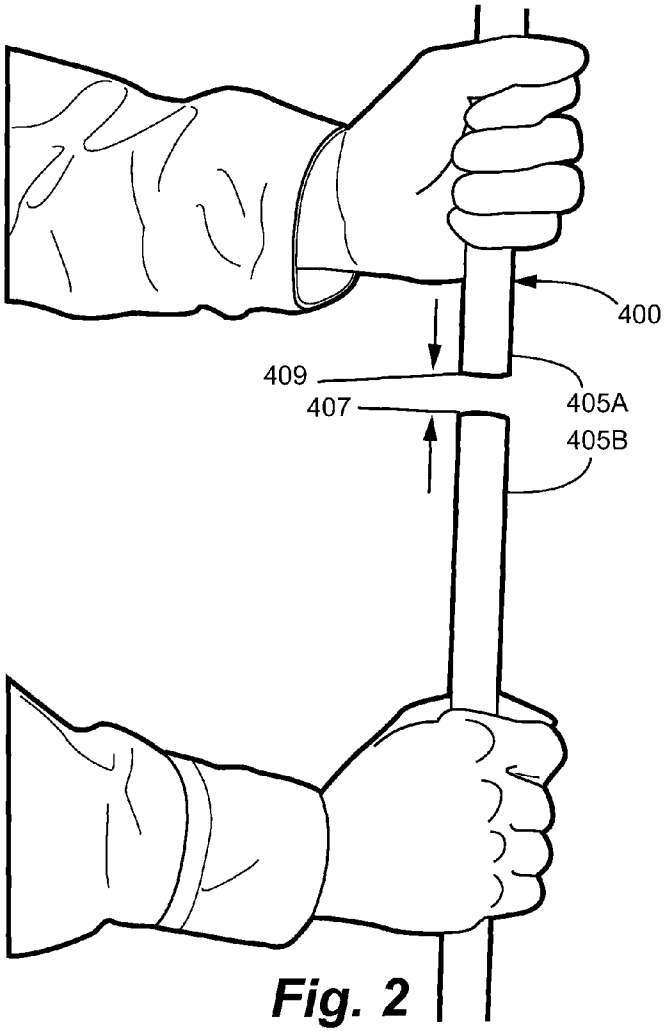
FIG. 2 illustrates a perspective view of assembling a mount assembly of the decorative system, in accordance with an exemplary embodiment of the present invention.
Figure 3:
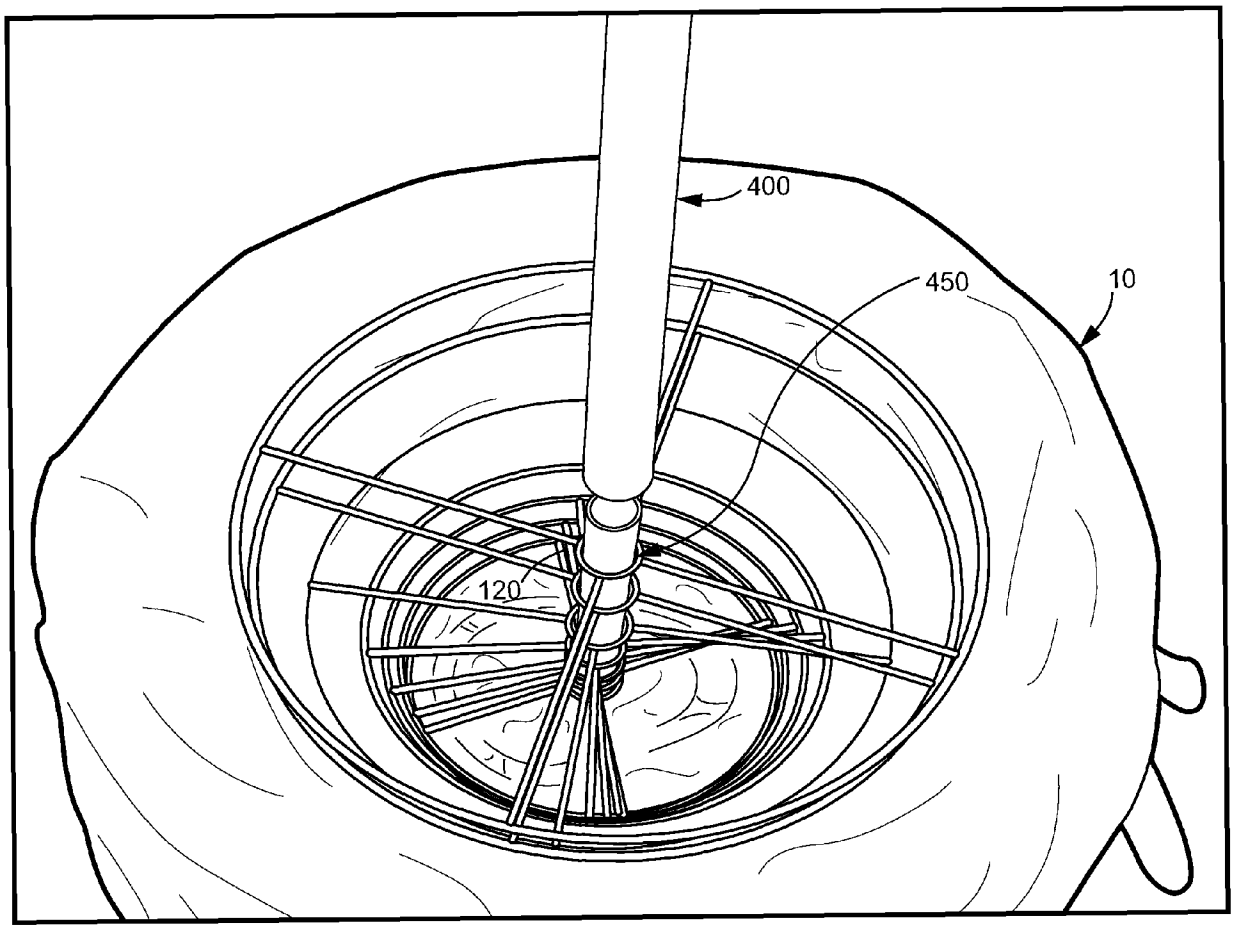
FIG. 3 illustrates another perspective view of assembling the mount assembly of the decorative system, in accordance with an exemplary embodiment of the present invention.
Figure 4:
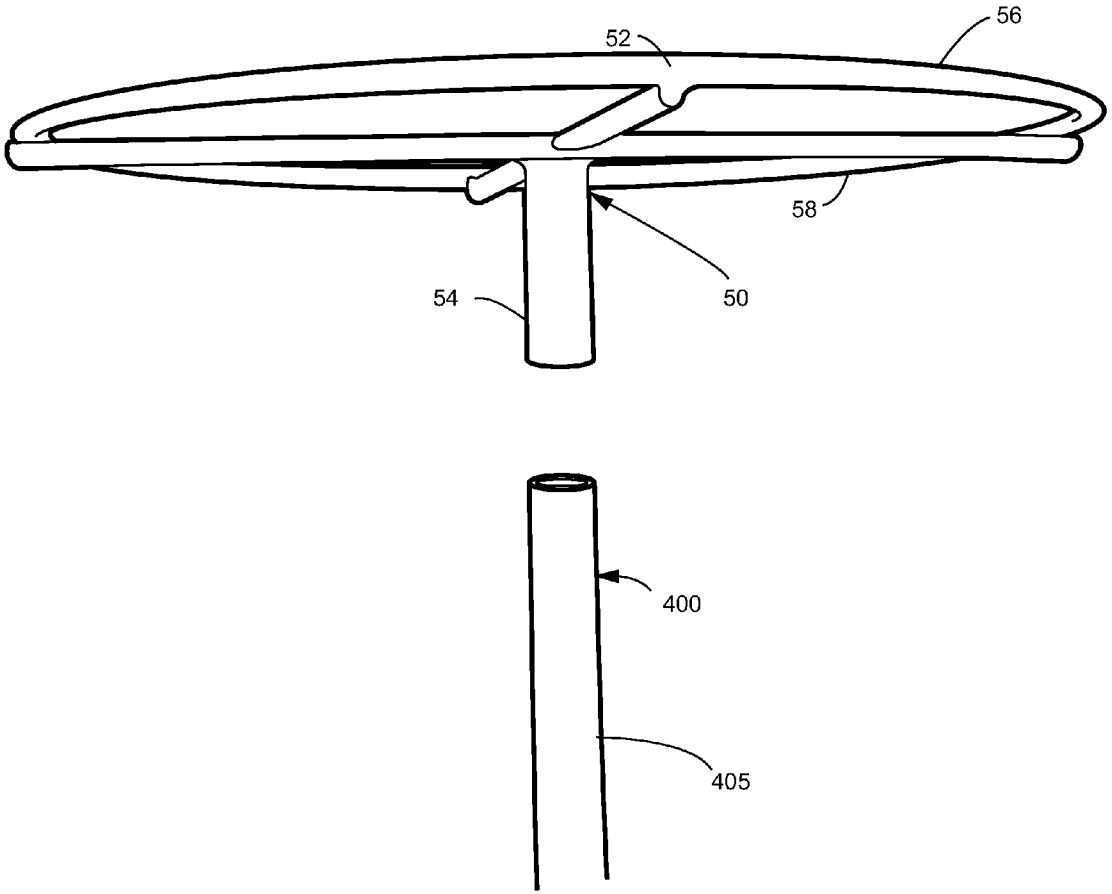
FIG. 4 illustrates a side view of connecting the mount assembly to a base, in accordance with an exemplary embodiment of the present invention.
Figure 5:
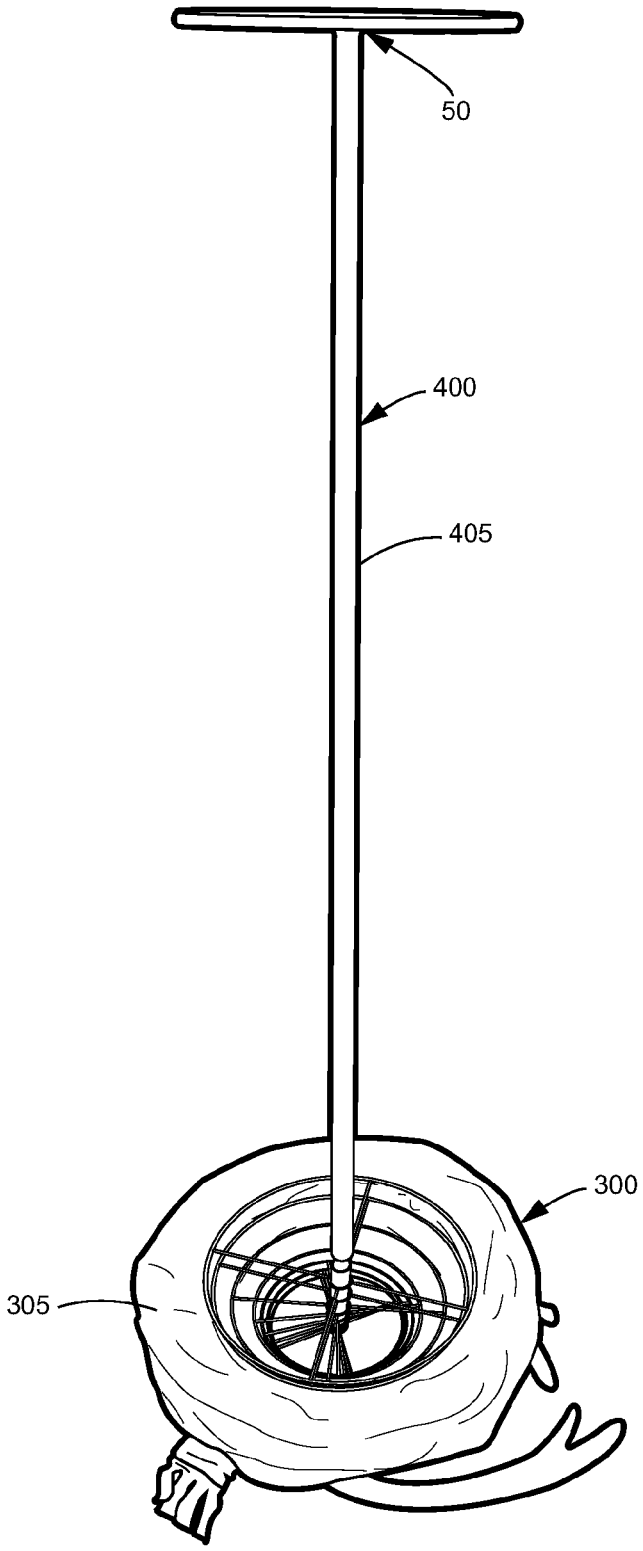
FIG. 5 illustrates a side view of the mount assembly connected to the base, in accordance with an exemplary embodiment of the present invention.
Figure 6:
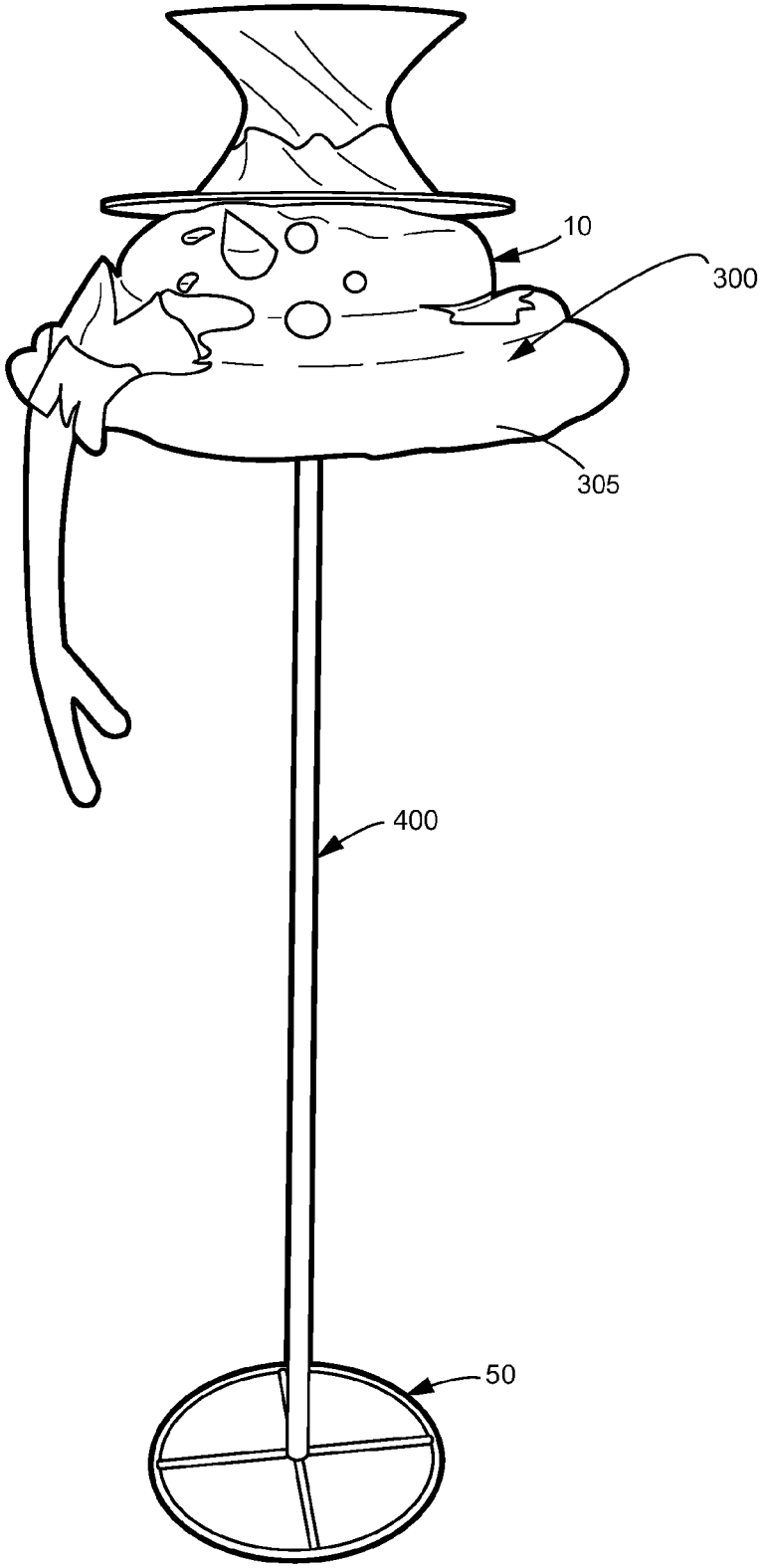
FIG. 6 illustrates a side view of a manner of assembling the decorative system, in accordance with an exemplary embodiment of the present invention.

In an exemplary embodiment, the mount assembly 400 can include at least two elongate rods 405. Each of the elongate rods 405 includes a receiving end 407 and an opposite insertion end 409. In assembling the mount assembly 400, a receiving end 407 of a first elongate rod 405A can receive the top end assembly 450. An insertion end 409 of the first elongate rod 405A can be inserted into a receiving end 407 of a second elongate rod 405B. An insertion end 409 of the second elongate rod 405B can be received by the upwardly extending portion of the base 50. As the elongate rods 405A and 405B are coupled together they can be received and inserted through the rings 120 of each frame assembly 110/210, permitting the frame assemblies 110/210 to slide along the mount assembly 400, or more specifically along the coupled elongate rods 405. Exemplarily, this assembly of the mount assembly is generally illustrated in FIG. 2. In an alternative embodiment, the receiving ends and insertion ends of the elongate rods can be switched providing the opposite attachment than that described above, e.g., the insertion end of the first elongate rod can be received in the top end assembly and so forth.

A beneficial feature of the decorative system 10 is its substantially flat arrangement in a collapsed state. An exemplary width of the decorative system 10 in a collapsed form is less than two inches. The width can be dependent on the size of the design and, for example and not limitation, the length of each elongate rod.

The decorative system 10 can further include a light string system 500. The light string system 500 can be in communication with any one of the first frame assembly 100, the second frame assembly 200, and/or the decorative covering 300. The light string system 500 provides illumination to the decorative system 10 and provides a decorative light system.

Figure 10A:
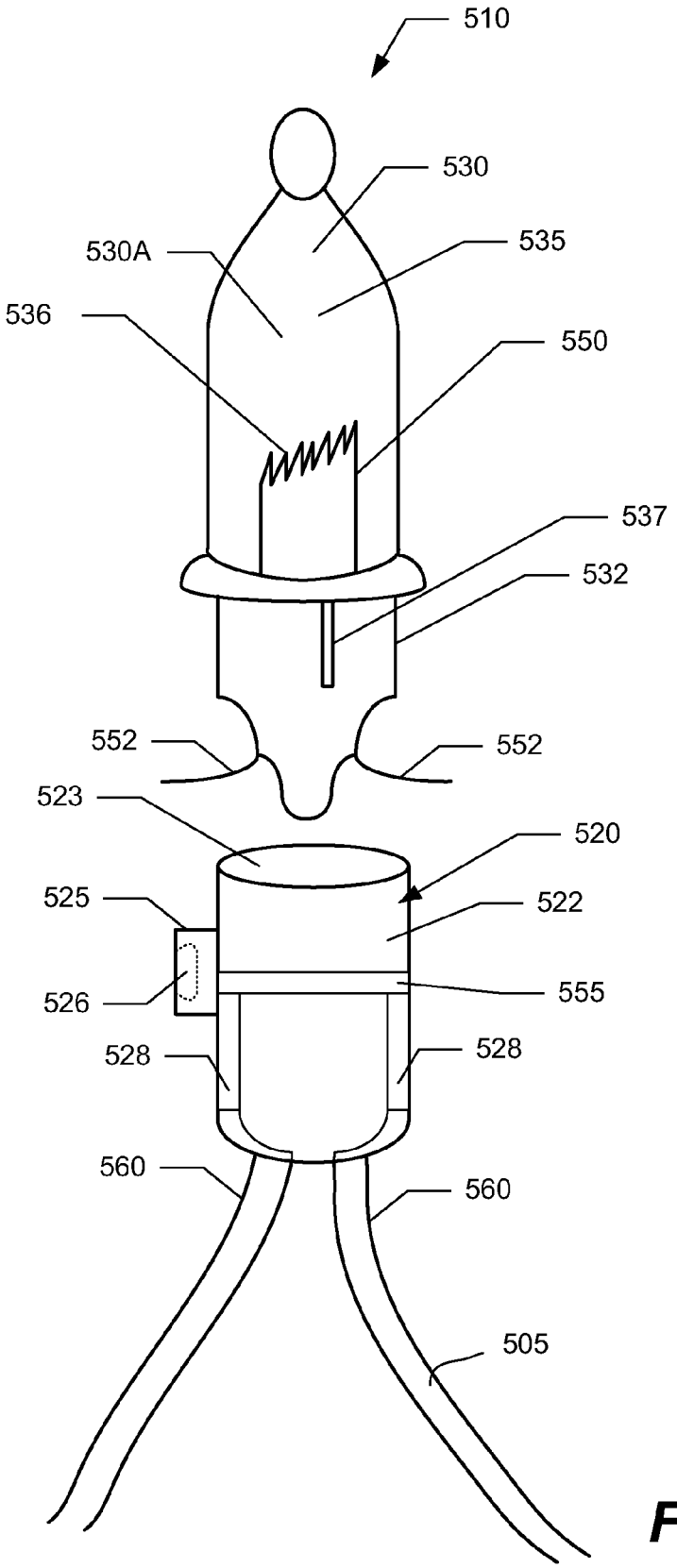
FIG. 10A is a side, partial cross-sectional view of a bulb assembly of the decorative light system, in accordance with an exemplary embodiment of the present invention.
Figure 10B:
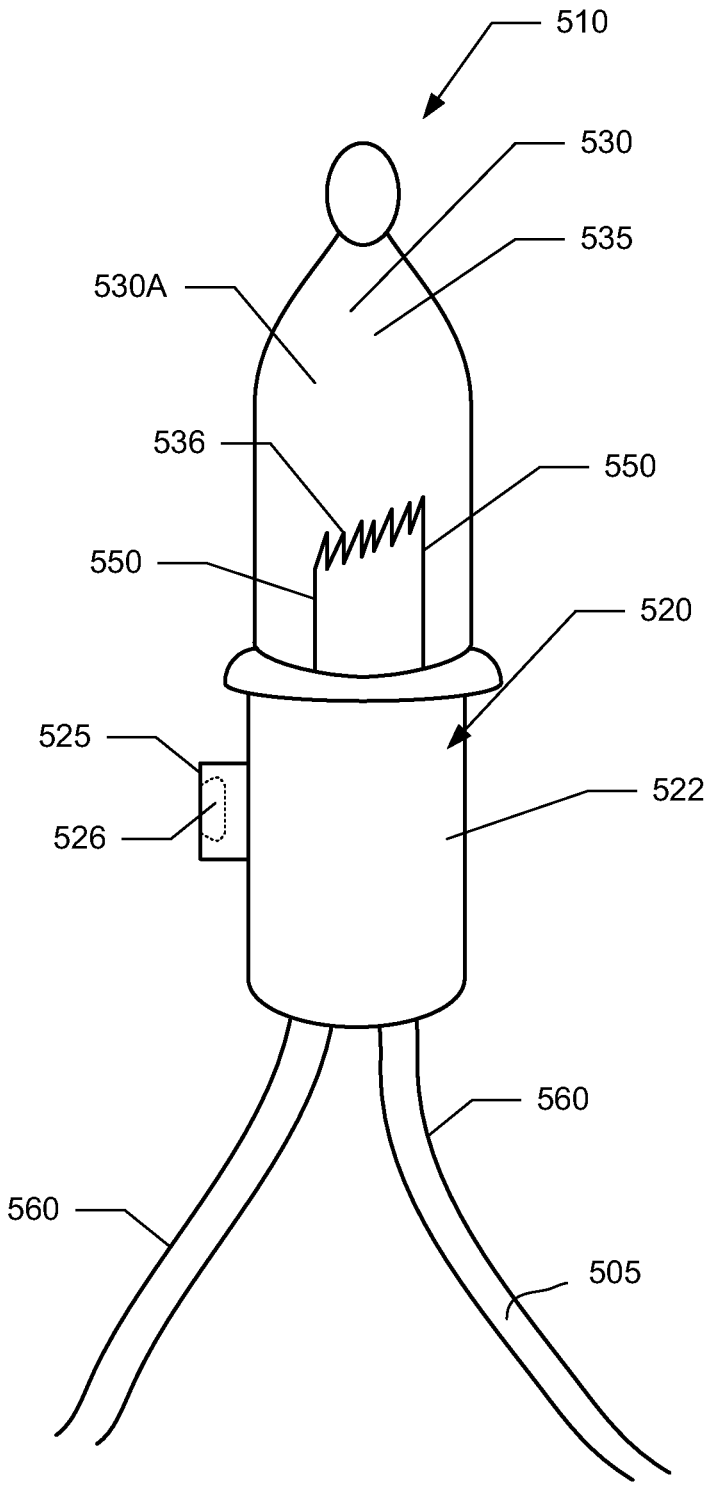
FIG. 10B is a side, partial perspective view of the bulb assembly of the decorative light system of FIG. 10A, wherein the light bulb is seated in the socket assembly, in accordance with an exemplary embodiment of the present invention.

Referring now to FIGS. 10A and 10B, the light string system 500 comprises a plurality of bulb assemblies 510, each bulb assembly 510 including a light source 530, a base 532, and a socket assembly 520. The light source 530 provides light when energized. One skilled in the art can appreciate that the light source 530 can be many types of light sources, including a light bulb, light emitting diode (LED), incandescent lamp, halogen lamp, fluorescent lamp, and the like. In one embodiment, the light source 530 is a light bulb 530A. The bulb assembly 510 can include a shunting mechanism to keep a light string system 500 illuminated, even if one of its light bulbs 530A burns out.

The light bulb 530A can include a globe 535 and a filament 536. The globe 535 is in communication with, and terminates at, the base 532. The globe 535 can be made of conventional translucent or transparent material such as plastic, glass, and the like. Typically, the globe 535 defines a hollow interior enabling protection of the filament 536.

The filament 536, when charged with energy, can illuminate the light bulb 530A. Conductors 550 can be in electrical communication with the filament 536. The conductors 550 enable energy into the light bulb 530A to illuminate the filament 536, and thus the light bulb 530A. The conductors 550 extend down through the base 532, wherein the conductors 550 can be in communication with a pair of lead wires 552 external the base 532. The lead wires 552 extend through a bottom of the base 532, and are a pair of wires wrapped around the base 532 extending upwardly in the direction of globe 535, adjacent the base 532.

The bulb assembly 510 further includes the base 532. The base 532 can be integrally formed with the light source 530. The base 532 can be a unitary element of the light bulb 530A, or a separate element. The base 532 communicates between the light bulb 530A and an associated socket 522 of the socket assembly 520, complimenting and facilitating the seating of the light bulb 530A to the socket 522. The base 532 can incorporate at least one ridge 537 to ensure a snug fit with the socket 522, preventing the accidental disengagement of the light bulb 530A from the socket assembly 520. Other mechanical means can be used with the base 532 and the socket assembly 520 to ensure a tight fit.

The socket assembly 520 comprises the socket 522 adapted to receive the light bulb 530A/base 532. The socket 522 defines a cooperatively-shaped aperture 523 to receive the base 532 of the bulb assembly 510. The socket 522 can be arranged in many shapes and sizes, but the socket 522 should be of a shape to conveniently receive the light bulb 530A/base 532.

The socket 522 further includes a pair of socket terminals 528. The socket terminals 528 are located on opposing inner sides of the socket 522. The socket 522 further includes a pair of terminal wires 560 extending to the exterior to allow energy to enter (and exit) the socket 522. Each socket terminal is, essentially, an extension of each respective terminal wire 560. The terminal wire 560 extends through the bottom of the socket 522 and is ultimately connected to an electrical source.

Light strings, such as the decorative light system 10, are typically arranged with bulb assemblies 510 on the strings being electrically connected in series, rather than in a parallel arrangement. Unfortunately, there are disadvantages to designing a light string in series. When even a single light bulb is removed from a socket, the entire series of lights is rendered inoperable. Because each light bulb within its respective socket completes the electrical circuit, when a light bulb is removed or the filament of the bulb burns out, a gap is created in the circuit; that is, an open circuit is created. Thus, electricity is unable to continue to flow through the circuit.

To overcome this dilemma, the socket assembly 520 can include a shunting device 555 to enable the energy flowing through the light string system 500 to continue to flow even when a light source 530 is absent from the socket 522. For instance, the light bulbs 530A in the light string system 500 will remain illuminated even though there may exist: an open filament 536, for example, a dead light bulb 530A, faulty or damaged light bulb 530A, faulty socket 522, or simply because the light bulb 530A is not properly mounted in its respective socket 522, or is entirely removed or falls out of its respective socket 522. For instance, the bypass activating system described in Massabki et al., U.S. Ser. No. 11/573, 505, filed Jun. 23, 2006, the entire disclosure of which is incorporated herein by reference, can be used as the shunting device 555.

The socket assembly 520 can include an extending member 525, which is external to the socket 522. Upon light installation of the decorative light system 100, the extending member 525 being sufficiently sized, can be secured into an extending member slit/aperture 335 of the second sheet 310. The extending member aperture 335 is positioned adjacent to the slit/aperture 330, enabling the further securing of the bulb assembly 510 to the decorative light system 100. In one embodiment, the extending member 525 is approximately the same width as the diameter of the socket 522. The extending member 525 can also include a loop or grip 526. The grip 526 can be sufficiently sized to secure at least two terminal wires 560.

Embodiments of the present invention further relate to a method of assembling the decorative system 10. When shipped, the decorative system 10 can be in its collapsed state, which reduces costs associated with shipping and minimizes storage space. Eventually, the decorative system 10 can be assembled. In some embodiments, the mount assembly 400 includes a plurality of elongate rods 405. These elongate rods 405 can be connected be inserting the end of one rod 405A into an end of another rod 405B (see e.g. FIG. 2). The assembled mount assembly 400 can be coupled to the top end assembly 450. In an exemplary embodiment, an end of the top end assembly 450 can receive or be inserted to a first end of the mount assembly, or a first end of one of the elongated rods. The assembled mount assembly 400 can be inserted through the openings or rings in the interior of the frame assemblies. A second end of the mount assembly can be connected to the base. The frame assemblies can move along the length of the mount assembly. For example, the frame assemblies can fall from the top end assembly via gravity and along the mount assembly to the base. The frame assemblies can be pulled along the length of the mount assembly to assemble the decorative system in an assembled state. At least one of the frame assemblies can include a locking element 475, for locking the decorative system in the assembled state. The locking element 475 locks the lowest most frame assembly to the base 50. Once the frame assembly is locked to the base, the decorative system is in its assembled state.

In an exemplary embodiment, the decorative system 10 is a wire frame structure that can be used to create a three-dimensional shape decorative system.

In an exemplary embodiment, the decorative system 10 can be altered between the collapsed and assembled states, and attached to a center mount, such that gravity permits the shape of the decorative system 10 to change automatically.

While the invention has been disclosed in its preferred forms, it will be apparent to those skilled in the art that many modifications, additions, and deletions can be made therein without departing from the spirit and scope of the invention and its equivalents, as set forth in the following claims.

What is claimed is:

1. A decorative system comprising:

a base providing a foundation for the decorative system;

a first frame assembly comprising a perimeter member in communication with a plurality of interior members, the interior members supporting the perimeter member and providing the structure for the perimeter member, the first frame assembly further comprising an ring member defined near the approximate center of the first frame assembly and in communication with the plurality of interior members;

a second frame assembly attached to a top end of a mount assembly, the second frame assembly separate and distinct from the first frame assembly and comprising a perimeter member in communication with a plurality of interior members, the interior members supporting the perimeter member and providing the structure for the perimeter member, the second frame assembly further comprising a ring member defined near the approximate center of the second frame assembly and in communication with the plurality of interior members;

a decorative covering carried by the perimeter member of the first frame assembly and the perimeter member of the second frame assembly such that the first frame assembly is operably connected to the second frame assembly by the decorative covering;

the decorative covering comprising a refractive mesh cover layer, the cover layer comprising tinted sections corresponding to the design of the decorative covering, the decorative covering having a plurality of outwardly extendable elements coupled to at least a portion of the decorative covering;

a light string system comprising a plurality of light sources, the light string system configured such that two or more light sources are disposed within the decorative covering;

the mount assembly providing support to the decorative system, the mount assembly comprising at least one vertical elongate rod running substantially the height of the decorative system, the mount assembly couplable to the base, and the rod configured to be received in the ring member of the first frame assembly and the ring member of the second frame assembly;

the first frame assembly and the second frame assembly configured to encircle a portion of the mount assembly at different locations; and the first frame assembly configured to slide along substantially the height of the mount assembly to provide an operational state.

2. The decorative system of claim 1, the first frame assembly further comprising a defined ring near an approximate center point of its perimeter, the second frame assembly further comprising a defined ring near an approximate center point of its perimeter, the defined ring of the first frame assembly and the defined ring of the second frame assembly configured to receive a portion of the mount assembly.

3. The decorative system of claim 1, the mount assembly comprising a plurality of interconnectable elongate rods, wherein a first end of a first elongate rod of the plurality of elongate rods is configured to receive a first end of a second elongate rod of the plurality of elongate rods.

4. The decorative system of claim 3, wherein an end of one of the plurality of elongate rods is configured to be received by or be inserted into an upwardly extending support of the base.

5. The decorative system of claim 1, the decorative covering coupled to the perimeter member of the first frame and the perimeter member of the second frame assembly.

6. The decorative system of claim 1, the light string system carried by one or more of the first frame assembly, the second frame assembly, and the decorative covering.

7. The decorative system of claim 6, the light string system comprising a plurality of bulb assemblies, each bulb assembly comprising:

a light assembly comprising a light source configured to illuminate with energized with power and a base integrally formed with the light source;

a socket assembly comprising a socket configured to receive the base of the light assembly, and a pair of socket terminals in communication with terminal wires to permit energy to enter and exit the socket.

8. The decorative system of claim 7, each bulb assembly further comprising a shunt mechanism incorporated into the socket assembly, the shunt mechanism configured to permit the light sources in the light string system to remain illuminated if one or more light assembly is missing from its respective socket assembly.

9. The decorative system of claim 1, the decorative covering comprising a fibrous material comprising a plurality of outwardly extending fibers coupled to at least a portion of the decorative covering.

10. A method of assembling a decorative system, the method comprising:

positioning a top member of the decorative system at the lowest point of the decorative system;

inserting a first end of a first elongate rod into a defined ring of a first frame assembly, the first frame assembly comprising a perimeter member in communication with a plurality of interior members, the interior members supporting the perimeter member;

inserting the first end of the first elongate rod into a defined ring of a second frame assembly which is separate and distinct from the first frame assembly and is connected to the top member, the second frame assembly comprising a perimeter member in communication with a plurality of interior members, the interior members supporting the perimeter member;

connecting the first end of the first elongate rod to the top member;

connecting a first end of a second elongate rod to a second end of the first elongate rod;

connecting a second end of the second elongate rod to an extending member of a base;

rotating the decorative system such that the top member moves from the lowest point of the decorative system to the highest point of the decorative system;

placing the decorative system on the base;

sliding the first frame assembly downward along substantially the length of the first and second elongate rods to provide an operational state;

locking the first frame assembly to the base to maintain the operational state; and energizing a light string comprising a plurality of light sources to enable two or more of the light sources to provide light from within a decorative covering, the decorative covering comprising a refractive mesh cover layer, the cover layer comprising tinted sections corresponding to the design of the decorative covering, and the decorative covering having a plurality of outwardly extendable elements coupled to at least a portion of the decorative covering.

11. The method of claim 10, wherein the top member is initially positioned as the lowest point of the decorative system for connecting the first elongate rod.

12. The method of claim 11, further comprising rotating the top member from the lowest portion of the decorative system to the highest point of the decorative system and thus placing the base on a support for the decorative system.

13. The method of claim 12, further comprising locking the second frame assembly to the base.

14. A decorative system having a first operational state and a second collapsed state, the decorative system configured to change states, the decorative system comprising:

a base providing a foundation for the decorative system, the base comprising a substantially flat bottom, a perimeter member, a plurality of interior members, and an upwardly extending member, wherein the interior members provide the structure for the perimeter member, and wherein the plurality of interior members intersect at the upwardly extending member;

a first frame assembly comprising a perimeter member in communication with a plurality of interior members, wherein the interior members provide the structure for the perimeter member, the first frame assembly including an ring member defined near the approximate center of the first frame assembly and in communication with the plurality of interior members;

a second frame assembly attached to a top end of a mount assembly, the second frame assembly separate and distinct from the first frame assembly and comprising a perimeter member in communication with a plurality of interior members, wherein the interior members provide the structure for the perimeter member, the second frame assembly including a ring member defined near the approximate center of the second frame assembly and in communication with the plurality of interior members;

a decorative covering carried by the perimeter member of the first frame assembly and the perimeter member of the second frame assembly such that the first frame assembly is operably connected to the second frame assembly by the decorative covering;

the decorative covering comprising a refractive mesh cover layer, the cover layer comprising tinted sections corresponding to the design of the decorative covering, the decorative covering having a plurality of outwardly extendable elements coupled to at least a portion of the decorative covering;

a light string system comprising a plurality of light sources, the light string system configured such that two or more light sources are disposed within the decorative covering;

the mount assembly providing support to the decorative system, the mount assembly comprising at least one substantially vertical elongate rod extending substantially the height of the decorative system, the rod configured to be received in the ring member of the first frame assembly and the ring member of the second frame assembly, the first frame assembly and the second frame assembly configured to encircle the mount assembly at different locations; and the first frame assembly configured to slide along substantially the height of the mount assembly to provide an operational state.

15. The decorative system of claim 14, the mount assembly comprising a plurality of interconnectable elongate rods, each of the plurality of interconnectable elongate rods comprising a receiving end and an inserting end.

16. The decorative system of claim 15, wherein an insertion end of a first elongate rod of the plurality of interconnectable elongate rods is receivable in a top member of the decorative system, wherein a receiving end of the first elongate rod of the plurality of interconnectable elongate rods receives an inserting end of a second elongate rod of the plurality of interconnectable elongate rods, and wherein an inserting end of the second elongate rod is configured to be inserted into a receiving end of the upwardly extending member of the base.

17. The decorative system of claim 15, the light string system carried by at least one of the first frame assembly, the second frame assembly, and the decorative covering.

* * * * *